United States Patent [19]

Enderle

[11] 4,001,927

[45] Jan. 11, 1977

[54] HAND TOOL FOR REMOVING A MOVABLE MEMBER FROM A CONFINED SPACE ADJACENT A FIXED MEMBER

[76] Inventor: Norman Edward Enderle, 4400 Glenn Cannon St., Bakersfield, Calif. 93308

[22] Filed: Sept. 2, 1975

[21] Appl. No.: 609,586

[52] U.S. Cl. ..... 29/267; 29/239

[51] Int. Cl.[2] ..... B25B 27/02

[58] Field of Search ..... 29/239, 270, 267, 268, 29/225, 229; 81/302, 3 R

[56] References Cited

UNITED STATES PATENTS

| | | | |
|---|---|---|---|
| 1,217,686 | 2/1917 | Barnett | 29/229 |
| 3,094,018 | 6/1963 | Collett | 81/302 |
| 3,886,644 | 6/1975 | Koch, Jr. | 29/270 |

*Primary Examiner*—Al Lawrence Smith
*Assistant Examiner*—Roscoe V. Parker
*Attorney, Agent, or Firm*—Max E. Shirk

[57] ABSTRACT

A first lever has an end which engages the fixed member, a second lever has an end which will dig into the movable member and a link is pivotally connected to each lever adjacent its working end so that both levers may be squeezed together causing the working end of the second lever to dig into the movable member. The second lever may then be moved axially to pull the movable member.

2 Claims, 6 Drawing Figures

HAND TOOL FOR REMOVING A MOVABLE MEMBER FROM A CONFINED SPACE ADJACENT A FIXED MEMBER

BACKGROUND OF THE INVENTION

The background of the invention will be set forth in two parts.

1. Field of the Invention

The present invention pertains generally to hand tools and more particularly to a new and useful hand tool especially designed for removing a movable member from a confined space adjacent a fixed member.

2. Description of the Prior Art

Removal of the upper arcuate main bearing shells from an engine block have been a problem.

It sometimes takes two men several minutes to remove these bearing shells. One man works the crankshaft while the other man takes a flexible thin tool, like a long feeler gauge, and taps the bearing shell around the bearing surface a little at a time. This flexible thin tool must be used in extremely cramped quarters, further adding to the problem.

U.S. Pat. No. 3,886,644 discloses an upper main bearing removal tool including a reciprocable member mountable on one of the stud bolts between the nut and the engine block. The reciprocable member has a pawl pivotably mounted thereon. The pawl extends toward the main bearing seat when the reciprocable member is mounted on the stud bolts and is biased away from the stud bolt. The tool also includes an arcuate member substantially similar to the main bearing shell. This arcuate member has ratchet teeth cut in its outersurface and is effective when placed against the crankshaft bearing surface with one end abutting the end of the main bearing shell nearest the pawl to engage the pawl with its ratchet teeth and push the main bearing shell out of the main bearing seat as the nut on the stud bolt is screwed alternately down and back.

One difficulty with this tool resides in the fact that it is time consuming to set the tool up initially. Another difficulty resides in the fact that it is also time consuming to alternately screw the nut on the stud bolt down and back.

SUMMARY OF THE INVENTION

In view of the foregoing factors and conditions characteristic of prior art hand tools for removing a movable member from a confined space adjacent a fixed member, it is a primary object of the present invention to provide a new and useful hand tool of the type described which is especially designed for removing movable members, such as upper main bearings, from a confined space, such as a bearing seat in an engine block, adjacent a fixed member efficiently and expeditiously.

According to a presently-preferred embodiment of the invention, a hand tool is provided for removing a movable member from a confined space adjacent a fixed member. The tool is shown herein for purposes of illustration, but not of limitation as comprising a main bearing removal device for use with an engine having a block with at least one arcuate bearing seat, a crankshaft having a journal surface adjacent the bearing seat, an arcuate bearing shell in the arcuate bearing seat between the bearing seat and the crankshaft journal surface and at least one shoulder on the block adjacent the bearing seat for receiving one end of a bearing cap.

The device may comprise a first lever for engaging the shoulder, a second lever for engaging the arcuate bearing shell and a link pivotably connecting the first and second levers together near their working ends for pivotal and axial movements with respect to each other, whereby the levers may be squeezed together causing the working end of the second lever to dig into the arcuate bearing shell whereupon the second lever may be pulled axially to move the arcuate bearing shell one increment. The second lever may then be moved axially toward the arcuate bearing seat for a fresh bite.

The features of the present invention which are believed to be novel are set forth with particularity in the appended claims. The present invention, both as to its organization and manner of operation, together with further objects and advantages thereof, may best be understood by reference to the following description, taken in connection with the accompanying drawing in which like reference numbers refer to like elements in the several views.

DESCRIPTION OF THE PREFERRED EMBODIMENT

Figure 2:
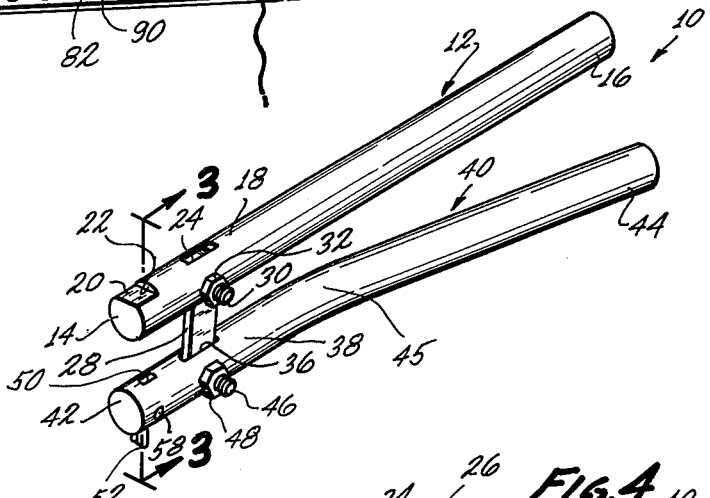
FIG. 2 is a perspective view of a hand tool constituting a presently-preferred embodiment of the invention.
Figure 3:
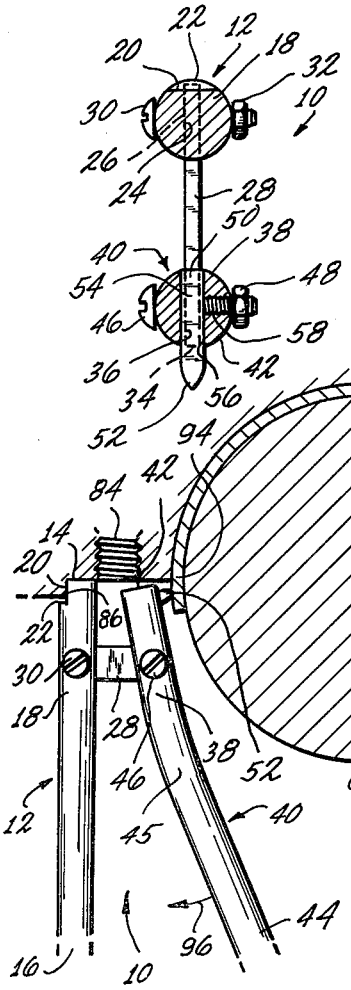
FIG. 3 is an enlarged cross-sectional view taken along line 3—3 of FIG. 2.
Figure 4:
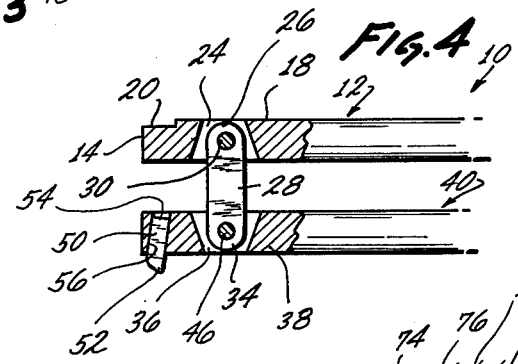
FIG. 4 is a longitudinal, partial cross-sectional view of the tool of FIG. 2.

Referring again to the drawing, and more particularly to FIGS. 2–4, a hand tool constituting a presently-preferred embodiment of the invention, generally designated 10, includes a first lever 12 having a work-engaging end 14, a second end 16, which defines a hand grip, and an intermediate portion 18.

Work-engaging end 14 is undercut to provide a flat land 20 and a slight shoulder 22. The intermediate portion 18 is provided with a transverse, elongated bore 24 providing working room for one end 26 of a link 28 pivotably secured to intermediate portion 18 by a bolt 30 and a nut 32. Link 28 includes a second end 34 pivotably mounted in a second elongated, transverse bore 36 provided in the intermediate portion 38 of a second lever 40 having a work-engaging end 42 and a second end 44, which defines a second grip portion. Lever 40 may be bent, as shown at 45, so that grip portion 44 diverges outwardly from grip portion 16; this provides working room between levers 12, 40 for the hands of a user of tool 10. End 34 of link 28 is connected to intermediate portion 38 by a bolt 46 and a nut 48. Work-engaging end 42 of lever 40 carries a blade 50 having a first end 52, which may be sharpened to provide a cutting edge, and a second end 54 (FIGS. 3 and 4) which may be adjustably mounted in a channel 56, which is provided in work-engaging end 42. Blade 50 may be retained in position in channel 56 by a set screw 58 (FIG. 2) and may be adjusted so that tool 10 may be used on engines of different sizes.

Figure 1:
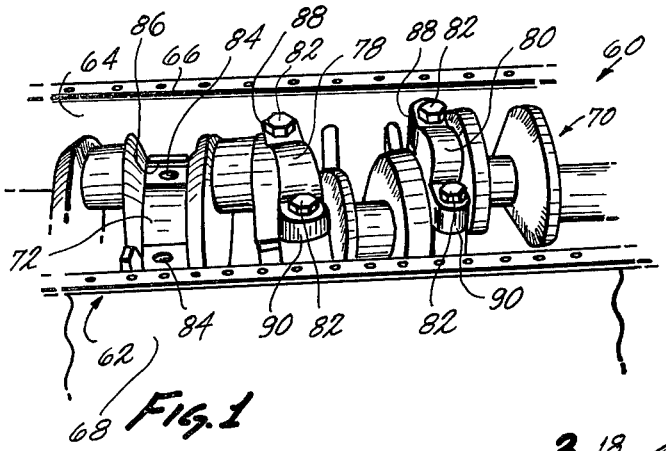
FIG. 1 is a partial perspective view of an engine block looking in from the bottom after the pan, piston rods and one main bearing cap have been removed.
Figure 5:
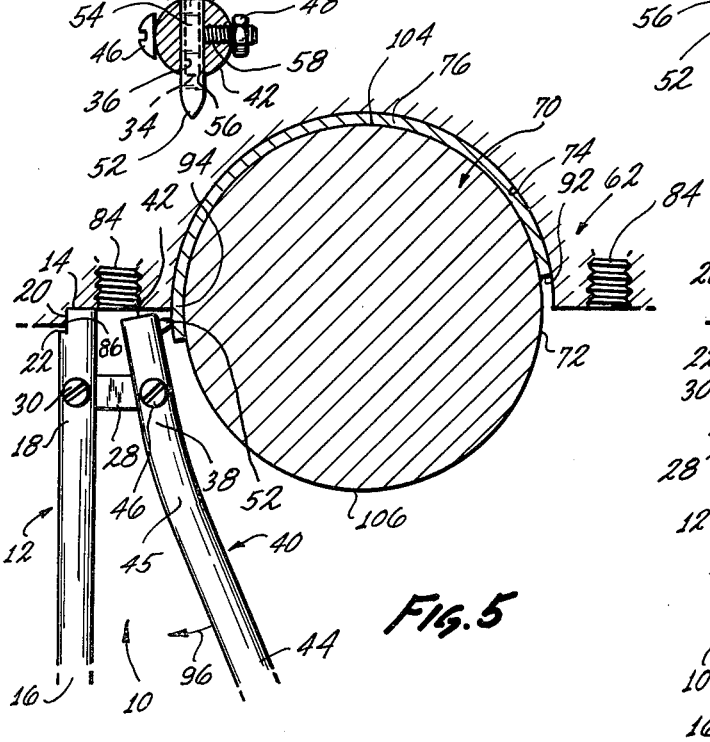
FIG. 5 shows a portion of the engine block of FIG. 1 greatly enlarged and in cross-section with the tool of FIG. 2 in position preparatory to making a working stroke.
Figure 6:
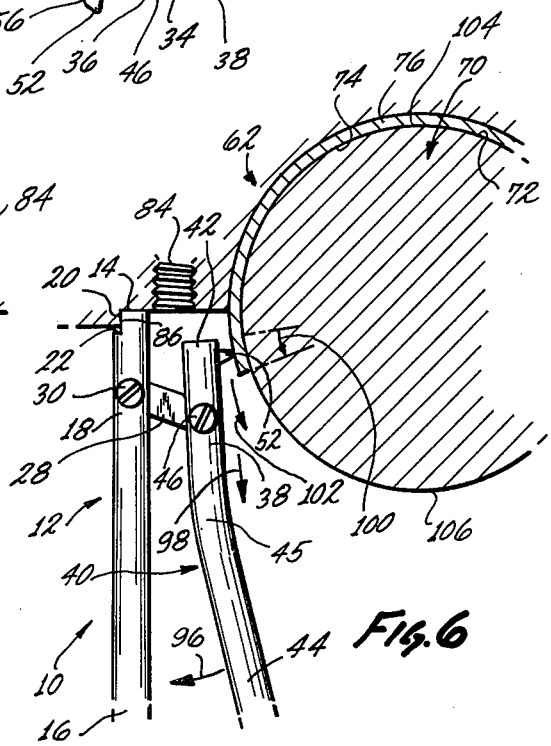
FIG. 6 is a view similar to FIG. 5, but showing the tool of FIG. 2 after it has made a working stroke.

Referring now to FIGS. 1, 5 and 6, although tool 10 may be used for removing any movable member from a confined space adjacent a fixed member, it may be advantageously used as a main bearing removal device for use with an engine 60 having a block 62 including an open bottom 64 and side walls 66, 68.

A crankshaft 70 is rotatably mounted in block 62 and includes suitable journal surfaces, like the one shown at 72, adjacent suitable arcuate bearing seats, like the one shown at 74 in FIGS. 5 and 6. An arcuate bearing shell or main bearing insert 76 may be mounted in bearing seat 74 between bearing seat 74 and crankshaft journal surface 72.

The crankshaft 70 is secured in position in block 62 by suitable bearing caps, like the two shown at 78, 80 in FIG. 1. Caps 78, 80 provide bearing seats for the lower half of the main bearing inserts (not shown) and may be secured to block 62 by cap screws 82 which threadedly engage tapped apertures 84 provided in block 62 adjacent suitable shoulders 86 against which the ends 88, 90 of bearing caps 78, 80 seat.

Operation of tool 10 will now be described in connection with FIGS. 5 and 6. A screwdriver or the like (not shown) may be applied to one end 92 of insert 76 (FIG. 5) and tapped lightly so that insert 76 will be moved slightly to expose its other end 94. The land 20 on work-engaging end 14 of lever 12 may then be seated against shoulder 86 and work-engaging end 42 of lever 40 may be positioned adjacent exposed end 94 of insert 76. Lever 40 may then be swung toward lever 12 in the direction of arrow 96 causing cutting edge 52 of blade 50 to bite into exposed end 94 of insert 76. While lever 12 is held firmly in engagement with shoulder 86, and while pressure is continued on lever 40 in the direction of arrow 96, lever 40 may be pulled axially downwardly, as indicated by arrow 98 in FIG. 6, causing end 94 of insert 76 to move a slight increment, as indicated by arrow 100, along a path defined by arrow 102.

Lever 40 may then be released and moved upwardly until blade 50 is again in its FIG. 5 position whereupon lever 12 is held firmly while lever 40 is moved in the direction of arrow 96 to bring cutting edge 52 into engagement with a newly exposed portion of end 94 of insert 76. Lever 40 may then be moved axially downwardly to expose another portion of insert 76. These operations may be rapidly repeated until insert 76 has been moved from the upper portion 104 of journal surface 72 to its lower portion 106.

A number of different materials from which tool 10 may be made will manifest themselves to those skilled in the art. For example, levers 12, 40 and link 28 may be made from mild steel. Blade 50, on the other hand, may advantageously be made from a carbide material. Additionally, each grip portion of levers 12, 40 may be provided with a shrunk-fit, polymeric sleeve (not shown), if desired.

While the particular hand tool herein shown and described in detail is fully capable of attaining the objects and providing the advantages hereinbefore stated, it is to be understood that it is merely illustrative of the presently-preferred embodiment of the invention and that no limitations are intended to the details of construction or design herein shown other than as defined in the appended claims, which form a part of this disclosure.

Whenever the term "means" is employed in these claims, this term is to be interpreted as defining the corresponding structure illustrated and described in this specification or the equivalent of the same.

What is claimed is:

1. A main bearing removal device for use with an engine having a block with at least one arcuate bearing seat, a crankshaft having a journal surface adjacent said arcuate bearing seat, an arcuate bearing shell in said arcuate bearing seat between said bearing seat and said crankshaft journal surface and at least one shoulder on said block adjacent said bearing seat for receiving one end of a bearing cap, said device comprising:

a first lever having a work-engaging end, an intermediate portion and a second end, said second end defining a grip portion, said first end being provided with a flat land and a shoulder for engaging said shoulder on said block, said intermediate portion being provided with an elongated bore;

a second lever having a work-engaging end, an intermediate portion and a second end, said second end defining a grip portion, said work-engaging end being provided with a blade having a major axis which is normal to the major axis of said second lever and which is adapted to engage said arcuate bearing shell, said intermediate portion of said second lever being provided with an elongated, transverse bore;

a link having a first end disposed in said bore in said first lever and a second end disposed in said bore in said second lever;

a first pin pivotably connecting said first end of said link to said first lever; and a second pin pivotably connecting said second end of said link to said second lever.

2. A main bearing removal device for use with an engine having a block with at least one arcuate bearing seat, a crankshaft having a journal surface adjacent said arcuate bearing seat, an arcuate bearing shell in said arcuate bearing seat between said bearing seat and said crankshaft journal surface and at least one shoulder on said block adjacent said bearing seat for receiving one end of a bearing cap, said device comprising:

a first lever having a work-engaging end, an intermediate portion and a second end, said second end defining a grip portion, said first end being engagable with said shoulder on said block, said intermediate portion being provided with an aperture;

a second lever having a work-engaging end, an intermediate portion and a second end, said second end defining a grip portion, said work-engaging end being provided with a blade having a major axis which is normal to the major axis of said second lever and which is adapted to engage said arcuate bearing shell, said intermediate portion of said second lever being provided with an aperture;

a link having first and second ends each provided with an aperture;

a first pin pivotably disposed in said apertures on said first lever and on said first end of said link for connecting said first end of said link to said first lever; and a second pin pivotably disposed in said apertures on said second lever and on said second end of said link for connecting said second end of said link to said second lever.

* * * * *